US009103243B2

(12) United States Patent
Hartlieb et al.

(10) Patent No.: US 9,103,243 B2
(45) Date of Patent: Aug. 11, 2015

(54) VALVE TRAIN FOR GAS EXCHANGE VALVES OF AN INTERNAL COMBUSTION ENGINE HAVING A DOUBLE-SUPPORTED CAM CARRIERS

(75) Inventors: Michael Hartlieb, Schweinfurt (DE); Manfred Elbl, Wettstetten (DE); Robert Poida, Grossmehring (DE); Andreas Ewald, Ingolstadt (DE)

(73) Assignee: AUDI, AG, Ingolstadt (DE)

( * ) Notice: Subject to any disclaimer, the term of this patent is extended or adjusted under 35 U.S.C. 154(b) by 1008 days.

(21) Appl. No.: 12/999,491

(22) PCT Filed: May 26, 2009

(86) PCT No.: PCT/EP2009/003708

§ 371 (c)(1),
(2), (4) Date: Mar. 11, 2011

(87) PCT Pub. No.: WO2009/152927

PCT Pub. Date: Dec. 23, 2009

(65) Prior Publication Data

US 2011/0180027 A1 Jul. 28, 2011

(30) Foreign Application Priority Data

Jun. 16, 2008 (DE) ..... 10 2008 028 513

(51) Int. Cl.
*F01L 1/04* (2006.01)
*F01L 13/00* (2006.01)
*F01L 1/053* (2006.01)

(52) U.S. Cl.
CPC ..... *F01L 13/0036* (2013.01); *F01L 1/053* (2013.01); *F01L 2013/0052* (2013.01)

(58) Field of Classification Search
CPC ..... F01L 1/08; F01L 1/047; F01L 2013/0052; F01L 2013/0078; F01L 1/053; F01L 13/0036
USPC ..... 123/90.6, 90.17, 90.18, 90.44, 123/345–348, 90.21
See application file for complete search history.

(56) References Cited

U.S. PATENT DOCUMENTS 4,794,893 A * 1/1989 Masuda et al. ..... 123/90.17
5,099,806 A * 3/1992 Murata et al. ..... 123/90.16

(Continued)

FOREIGN PATENT DOCUMENTS

DE 4419637 A1 12/1994
DE 10148179 A1 4/2003

(Continued)

OTHER PUBLICATIONS

English translation by machine of JP 06307216 A.*

*Primary Examiner* — Thomas Denion
*Assistant Examiner* — Jason T Newton
(74) *Attorney, Agent, or Firm* — Novak Druce Connolly Bove + Quigg LLP

(57) ABSTRACT

The invention relates to a valve train for gas exchange valves of an internal combustion engine, having a base camshaft, a plurality of cam carriers, which are arranged in a rotationally fixed and axially movable way on the base camshaft, as well as stopping devices for retaining the cam carriers in defined displacement positions along the base camshaft, with the stopping devices comprising in each case a pressure-applying element, which is inserted into a recess of the base camshaft and pressed in the radial direction of the base camshaft against an opposite inner circumferential section of the cam carrier. In order to counteract noise generation in the valve train, a first variant of the invention provides an additional pressure-applying element at an axial distance from the pressure-applying element. This additional pressure-applying element is pressed against an opposite inner circumferential section of the cam carrier. According to a second alternative or additional variant of the invention, the pressure-applying elements of different cam carriers are offset in relation to each other in the circumferential direction of the base camshaft.

6 Claims, 3 Drawing Sheets

(56) References Cited

U.S. PATENT DOCUMENTS

| | | | | |
|---|---|---|---|---|
| 5,813,377 | A * | 9/1998 | Matsunaga | 123/90.17 |
| 5,855,190 | A * | 1/1999 | Matsunaga | 123/90.17 |
| 6,343,581 | B2 * | 2/2002 | Suzuki | 123/90.17 |
| 8,887,681 | B2 * | 11/2014 | Wiesner et al. | 123/90.6 |
| 8,899,196 | B2 * | 12/2014 | Choi et al. | 123/90.16 |
| 2007/0034184 | A1 * | 2/2007 | Dengler | 123/90.17 |
| 2009/0064952 | A1 * | 3/2009 | Wutzler | 123/90.18 |
| 2015/0075468 | A1 * | 3/2015 | Takagi et al. | 123/90.18 |

FOREIGN PATENT DOCUMENTS

| | | | | |
|---|---|---|---|---|
| DE | 10148243 | A1 | 4/2003 | |
| DE | 102004056290 | A1 | 6/2006 | |
| EP | 1503048 | A1 | 2/2005 | |
| JP | 06307216 | A * | 11/1994 | F01L 13/00 |

* cited by examiner

VALVE TRAIN FOR GAS EXCHANGE VALVES OF AN INTERNAL COMBUSTION ENGINE HAVING A DOUBLE-SUPPORTED CAM CARRIERS

The invention relates to a valve train for gas exchange valves of an internal combustion engine.

BACKGROUND OF THE INVENTION

In order to improve the thermodynamic properties of internal combustion engines, valve trains are known, of which the operating cycle can be influenced in order to make it possible, for example, to vary, as a function of the rotational speed, the opening times or the lift of the gas exchange valves.

DE 10 2004 011 586 A1 of the applicant already discloses a valve train of the type that is described in the introduction. In this case, a plurality of cam carriers having a complementary internal toothing are arranged in a rotationally fixed and axially movable manner on a base camshaft, which is provided with an external toothing. In order to actuate two gas exchange valves of a cylinder, the associated cam carrier has two cam profile groups, each of which is arranged at an axial distance from each other and each of which has two different cam profiles. When the cam carriers are displaced axially on the base camshaft between two defined displacement positions, one of the two cam profiles of each cam profile group can be moved into abutting contact with a roller of a roller cam follower of the respective gas exchange valve. In order to hold the cam carriers in the two displacement positions in defined axial positions, the prior art valve train has stopping devices, each of which comprises a pressure-applying element in the form of a locking ball, which can be inserted into a radial blind borehole of the base camshaft and is pressed radially outward against an opposite inclined flank of a locking channel or locking groove by means of the force of a helical compression spring in the borehole. As a result, the locking balls act on the respective cam carrier with a radial and an axial force component, of which the latter serves to push the cam carrier against a front surface of a bearing block that serves as a stop and, in so doing, to hold this cam carrier in a defined axial position.

In the case of the valve train known from the prior art, the stopping devices are arranged radially inward from a cam profile group in close proximity to one of the two front ends of each cam carrier. In conjunction with the radial clearance, required to displace the cam carrier, between the external toothing of the base camshaft and the internal toothing of the cam carrier, the result is a slightly inclined position of the cam carrier. This in turn leads, upon each actuation of the valve, to an audible noise, when at the opposite front end of the cam carrier that is not pressed against the base camshaft, the internal toothing of the cam carrier strikes against the external toothing of the base camshaft owing to a change in engagement in the vicinity of the maximum valve lift.

Another factor that causes the generation of noise in the valve train is that in order to facilitate the production of the base camshaft, all of the blind boreholes, which serve to accommodate the helical compression springs and the stop balls, are aligned parallel to each other and terminate on the same side of the base camshaft. However, the different opening times of the gas exchange valves of the adjacent cylinders and the resulting necessary angular offset of the lift curves of the cams on the adjacent cam carriers may result in the radial forces, exerted on the cam carriers by the stop balls and/or the pressure-applying elements, having a different angular orientation with respect to the lift curves of the cam carriers, a state that may also be the cause for noises. Moreover, the parallel alignment of all boreholes also has the drawback that the reaction forces, exerted on the base camshaft by the helical compression springs, have altogether the same direction, so that the base camshaft is supported unilaterally via the cam carriers and is bent in this direction.

Working on this basis, the object of the invention is to counteract noise generation in the valve train.

SUMMARY OF THE INVENTION

This object is achieved, according to a first alternative of the invention, in that an additional pressure-applying element is provided at an axial distance from the pressure-applying element and is also pressed against an opposite inner circumferential section of the cam carrier, in order to avoid in this way a noise-generating knocking of an unsupported part of the cam carrier when a cam runs onto the roller cam follower that interacts with the cam and is a part of the gas exchange valve.

According to a preferred embodiment of this variant of the invention, the two pressure-applying elements of each cam carrier are pressed against the respective opposite inner circumferential section of the cam carrier with almost the same pressure forces, a feature that can be achieved in the simplest way by using the same or similar springs.

In order to guarantee an alignment of the longitudinal axis of the cam carrier with the axis of rotation of the base camshafts and, in so doing, to eliminate an inclined position of the cam carrier, the two pressure-applying elements of each cam carrier are pressed against the respective opposite inner circumferential section of the cam carrier with preferably the same orientation.

The orientation of the recesses, which serve to accommodate the pressure-applying elements, in the base camshaft with respect to the cams of the cam carriers, which are slid onto the base camshaft, is chosen preferably in such a way that the recesses terminate on the side of the base camshaft that is approximately opposite the cam lobes, that is, the apexes of the lift curves of the cams, so that the cam carriers on the side of the cam lobes and/or the lift curves of the cams are pressed against the base camshaft.

Wherever the cam carriers support two pairs of cams, and the cam lobes of each pair of cams exhibit a defined angular distance from each other in the circumferential direction of the base camshaft and the cam carriers, the orientation of the recesses is chosen in such an advantageous manner that the longitudinal axes of the recesses, which are configured expediently as boreholes, pass through between the cam lobes, which are arranged at an angular distance from each other.

Preferably, the two pressure-applying elements are located in close proximity to the opposite front ends of the cam carrier, that is, on the opposite sides of an axial center of the cam carrier, where they are arranged expediently on both sides of a section of the base camshaft that is provided with an external toothing. Preferably, the pressure-applying element of the stopping device is situated opposite a locking recess, while the additional pressure-applying element is situated opposite a cylindrical circumferential surface of the cam carrier that borders the internal toothing.

A second alternative of the invention and preferred embodiment of the first alternative of the invention provides that the pressure-applying elements of the various cam carriers are offset or rotated in the circumferential direction of the base camshaft in such a way that all of the pressure-applying elements exhibit the same orientation with respect to the lift curves of the cams. As a result, this ensures, first of all, that the direction of the force applied at all cams and/or cam carriers is the same, a circumstance that counteracts noise generation. Given a number of n cam carriers on the base camshaft, the mutual angular offset of the pressure-applying elements of adjacent cam carriers is preferably 360°/n or 2×360°/n. In this way, the base camshaft is uniformly supported in the bearings in all directions by the cam carriers and, therefore, remains straight.

The invention is explained in detail below by means of one embodiment depicted in the drawings.

DETAILED DESCRIPTION OF THE PREFERRED EMBODIMENTS OF INVENTION

Figure 1:
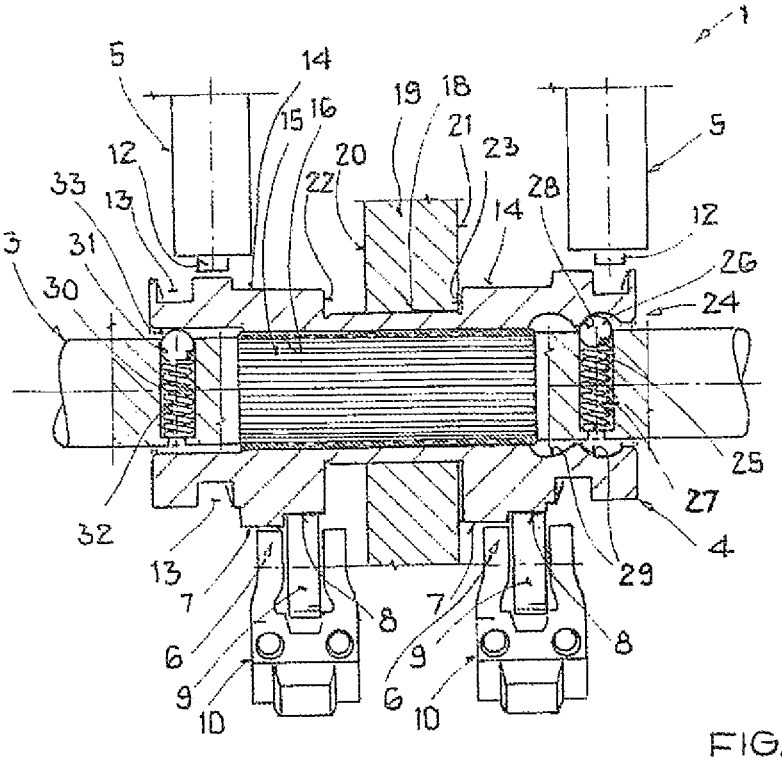
FIG. 1 is a partially cut side view of a section of a base camshaft and a cam carrier, which can be displaced on the base camshaft and is a part of the inventive valve train for gas exchange valves of an internal combustion engine.

In the case of the valve train 1, which is only partially depicted in the drawing, for pairs of intake valves 2 of four cylinders of an in-line engine, the lift and the opening times of both intake valves 2 of each cylinder can be adjusted.

In addition, the valve train 1 comprises a base camshaft 3, which is mounted in a rotatable manner, and four cam carriers 4, which are mounted in a rotationally fixed and axially movable manner on the base camshaft 3. FIG. 1 shows only one cam carrier in an enlarged longitudinal cross section. The valve train also comprises two actuators 5 for shifting each cam carrier 4 between two defined axial displacement positions.

The outer periphery of each cam carrier 4 has two pairs of cams 6, which are arranged at an axial distance from each other and each of which consists of two cams 7, 8. As best shown in FIGS. 1 and 3, each of the two pairs of cams 6 acts together with a roller 9 of a pivotally mounted roller cam follower 10 of the associated intake valve 2. When a cam carrier 4 is displaced in the axial direction, the rollers 9 can be moved, as desired, into abutting contact with one of the two cams 7, 8 of a pair of cams 6, so that during each revolution of the base camshaft 3 said rollers move once beyond a lift contour 11 of the cam 7, 8, as a result of which the roller cam follower 10 is pivoted while at the same time the valve 2 is opened. Owing to a different height, form, and/or position of the lift contours 11 of the two cams 7, 8, the lift and the opening time of each valve 2 can be changed as a function of the respective displacement position of the cam carrier 4, but independently of the lift and the opening time of the valves 2 of the other cylinders, for example, as a function of the rotational speed.

In order to displace the cam carriers 4, one of the two actuators 5 is actuated in order to move out a carrier pin 12 of the actuator 5 during one revolution of the cam carrier 4 and, in so doing, to engage with an opposite helical groove 13 on the adjacent front end of the cam carrier 4. The cam carrier 4 is always displaced when the base circular segments 14 of the cams 7, 8 of both pairs of cams 6 rest against the rollers 9 of the cam followers 10.

Figure 2:
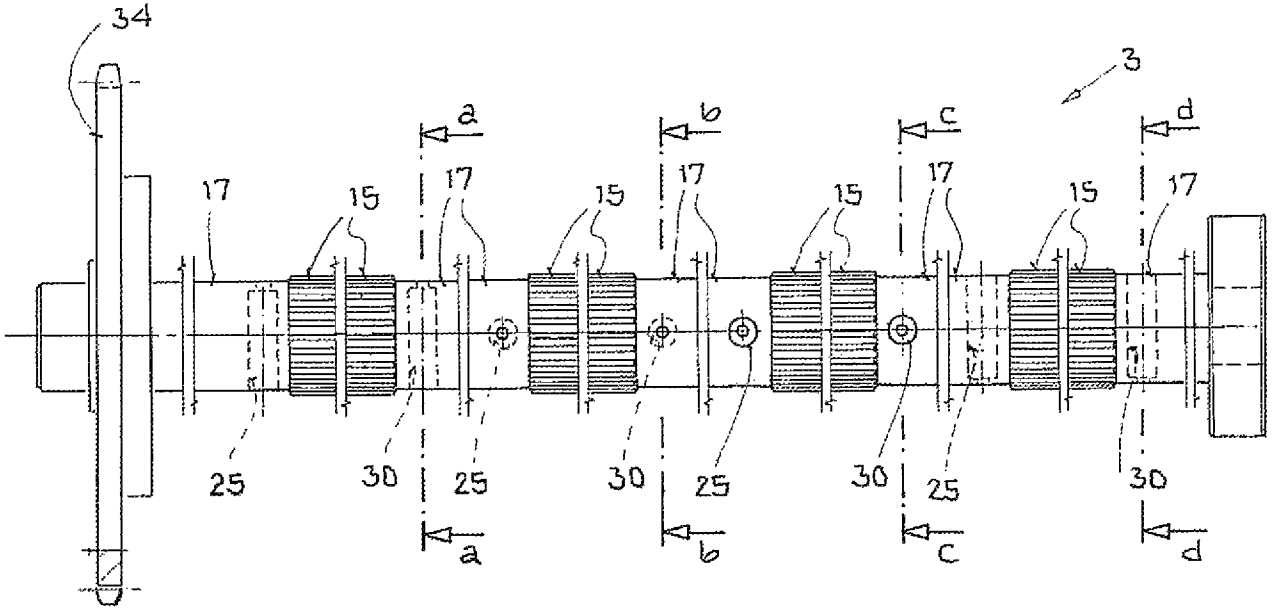
FIG. 2 is a side view of the entire base camshaft without cam carriers, that is, prior to their mounting on the base camshaft.
Figure 3A:
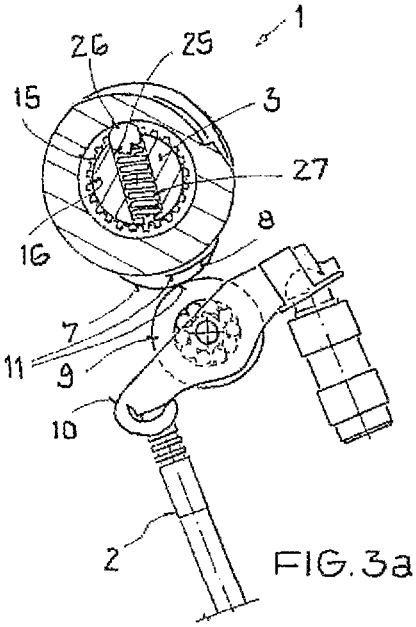
FIGS. 3*a* to 3*d* are cross-sectional views of the base camshaft along the lines a-a, b-b, c-c, and/or d-d of FIG. 2 following the mounting of the cam carriers on the base camshaft and on interaction of the same with the roller cam followers of gas exchange valves of four cylinders, arranged in series, at the same valve lift.
Figure 3B:
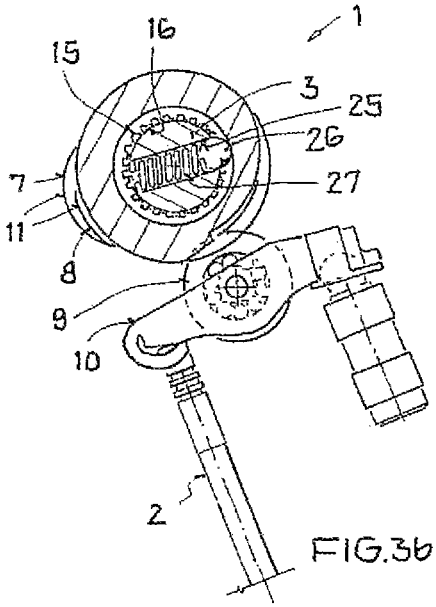
Figure 3C:
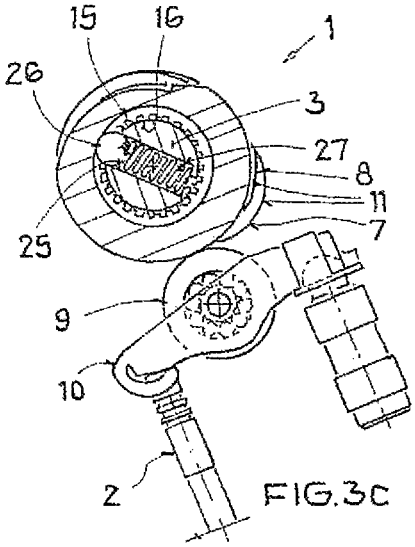
Figure 3D:
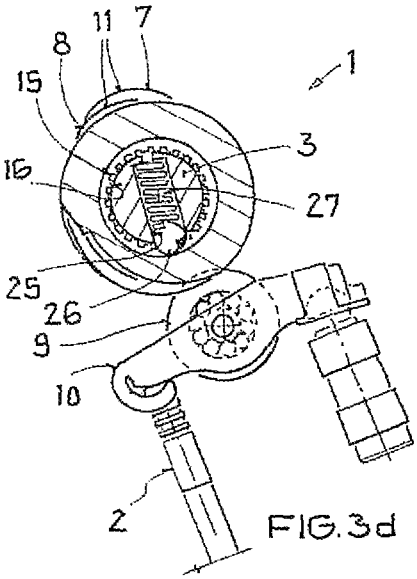

In order to guide the tubular cam carriers 4 in a rotationally fixed and axially movable manner on the base camshaft 3, the outer circumference of said base camshaft is provided in sections with an external toothing 15 inside of each associated cam carrier 4. The external toothing meshes with a complementary internal toothing 16 on the inner circumference of the associated cam carrier 4. As best shown in FIG. 2, there are between the adjacent sections, which are provided with an external toothing 15, sections 17 with a cylindrical peripheral surface, beyond which the external toothing 15 projects.

Each cam carrier 4 has a cylindrical section 18 between the two pairs of cams 5, 6. As best shown in FIG. 1, this cylindrical section is mounted in a plain bearing 19 that is mounted stationarily in the cylinder head housing. The plain bearing 19 has two opposite front surfaces 20, 21, which serve in both displacement positions as stops for an opposite front surface 22, 23 of the cam 8 and/or 7 that borders the section 18 and belongs to each pair of cams 6, in order to set a defined axial position of the cam carrier 4.

In order to hold the cam carriers 4 in their respective displacement positions in such a manner that they rest against the corresponding front surface 20 or 21 of the plain bearing 19, a front end of each cam carrier 4 has a stopping device 24. The stopping device comprises a radial blind borehole 25 in the base camshaft 3, in which a stop ball 26 is guided in a radially movable manner. Between the stop balls 26 and a bottom of the blind borehole 25 there is a helical compression spring 27, which presses the stop balls 26 radially outward against an inclined groove flank 28 in one of two locking grooves 29, which are recessed in an opposite inner circumferential section of the cam carrier 4 and, thus, presses the cam carrier 4 against one of the stop faces 20, 21, as described in detail in the applicant's German Patent DE 10 2004 011 586 A1, which was referred to in the introductory part of this specification.

In order to prevent the cam carrier 4 from assuming a slightly inclined position on the base camshaft 3, the opposite front end of the cam carrier 4 has a blind borehole 30, which runs parallel to the blind borehole 25 and in which a radially movable ball 31 is also pressed radially outward against an opposite inner circumferential section of the cam carrier 4 by means of the force of a helical compression spring 32. However, in contrast to the area of the stopping device 24, the inner circumferential section of the cam carrier has a cylindrical surface 33, which does not exhibit any locking grooves 29.

As best shown in FIGS. 1 and 2, the two blind boreholes 25, 30 terminate inside each cam carrier 4 on the same side of the base camshaft 3, whereas the two helical compression springs 27, 32 exhibit the same dimensions, so that the forces, exerted on the balls 26, 31 by the compression springs, exhibit the same direction and almost the same amount.

As best shown in FIG. 2, the pairs of blind boreholes 25, 30 for the four cam carriers 4, mounted on the base camshaft 3, are aligned, however, in such a manner that in each case they enclose an angle that matches the ignition sequence, that is, 90° and/or 180° in the embodiment shown in the drawing, with the blind boreholes 25, 30 for the adjacent cam carrier(s) 4. This angle also corresponds to the angular offset with which the adjacent cam carriers 4 for actuating the intake valves 2 of the successive cylinders in the row of cylinders are slid onto the base camshaft 3. This technical measure achieves with respect to all of the cam carriers 4 that the balls 26, 31 are arranged in the same position in relation to the lift curves 11 of the cams 7, 8, as shown in FIGS. 3*a* to 3*d*, so that in the case of all of the cam carriers 4 the directions of the forces, which are introduced into the cam carriers 4 by the helical compression springs 27, 32 via the balls 26, 31, have the same orientation relative to the lift curves 11. Thus, when the lift curves 11 run onto the rollers 9 of the roller cam followers 10, no noise is generated.

Secondly, arranging one of the four pairs of blind boreholes 25, 30 at an angle of 0°, 90°, 180°, and 270° allows the four cam carrier 4 to support uniformly the base camshaft 3 in the plain bearings 19, surrounding the cam carriers 4, as a result of which a unilateral bending is avoided.

The base camshaft 3 is driven by means of a sprocket wheel 34 of a chain drive (not illustrated). This sprocket wheel is arranged in close proximity to the base camshaft's one front end and is connected in a rotationally rigid manner to the base camshaft 3.

The invention claimed is:

1. An assembly of an internal combustion engine of a motor vehicle, comprising:

a camshaft having a pair of axially spaced, radially disposed guide recesses, a body disposed in each of said recesses and means disposed in each of said recess between said camshaft and said body for biasing said body radially outwardly; and a carrier provided with an opening receiving said camshaft therethrough, mounted on said camshaft, displaceable axially thereon and precluded from rotation relative thereto, at least one set of axially spaced cam surfaces disposed on the exterior thereof, a pair of axially spaced, annular surfaces disposed on the interior thereof, coaxially with said camshaft, wherein one of said interior annular surfaces of said carrier is provided with a pair of axially spaced, annular grooves, one of said radially biased bodies is receivable in a radially aligned one of said annular grooves upon axial displacement of said carrier relative to said camshaft and the other of said radially biased bodies is biased into engagement with the other of said axially spaced annular interior surfaces.

2. An assembly according to claim 1 wherein each of said bodies comprises a ball and each of said biasing means comprises a helical spring.

3. An assembly according to claim 1 including a bearing and wherein said carrier is journaled in said bearing and includes annular surfaces engageable with said bearing upon axial displacement of said carrier relative to said camshaft to selectively align said one body receivable in one of said annular grooves, with said annular groove.

4. An assembly according to claim 1 including means for displacing said carrier axially relative to said camshaft to selectively align said one of said bodies with one of said annular grooves.

5. An assembly according to claim 1 wherein said set of grooves and said annular surface of said carrier are cooperable with said radially biased bodies disposed in said recesses of said camshaft, are disposed on opposite sides of said bearing.

6. An assembly according to claim 1 wherein said cam surfaces of said carrier are engageable with recesses of a follower of a valve of said engine.

* * * * *

UNITED STATES PATENT AND TRADEMARK OFFICE

CERTIFICATE OF CORRECTION

PATENT NO. : 9,103,243 B2
APPLICATION NO. : 12/999491
DATED : August 11, 2015
INVENTOR(S) : Hartlieb et al.

It is certified that error appears in the above-identified patent and that said Letters Patent is hereby corrected as shown below:

IN THE CLAIMS

Claim 5 should read

5. An assembly according to claim 3 wherein said set of grooves.

Signed and Sealed this
Twenty-sixth Day of January, 2016

Michelle K. Lee

Michelle K. Lee
*Director of the United States Patent and Trademark Office*